US009540850B2

(12) United States Patent
Tanoguchi et al.

(10) Patent No.: US 9,540,850 B2
(45) Date of Patent: Jan. 10, 2017

(54) VEHICLE DOOR HANDLE DEVICE

(71) Applicants: Honda Motor Co., Ltd., Tokyo (JP); ALPHA Corporation, Yokohama-shi, Kanagawa (JP)

(72) Inventors: Kenichi Tanoguchi, Wako (JP); Daichi Okamoto, Wako (JP); Katsuya Ashizawa, Tochigi (JP); Yutaka Saito, Yokohama (JP)

(73) Assignees: HONDA MOTOR CO., LTD, Tokyo (JP); ALPHA CORPORATION, Yokohama-Shi (JP)

( * ) Notice: Subject to any disclaimer, the term of this patent is extended or adjusted under 35 U.S.C. 154(b) by 333 days.

(21) Appl. No.: 14/171,030

(22) Filed: Feb. 3, 2014

(65) Prior Publication Data

US 2014/0217756 A1 Aug. 7, 2014

(30) Foreign Application Priority Data

Feb. 6, 2013 (JP) ..... 2013-021793

(51) Int. Cl.

| | |
|---|---|
| ***E05B 3/00*** | (2006.01) |
| ***E05B 77/38*** | (2014.01) |
| *E05B 85/12* | (2014.01) |

(52) U.S. Cl.

CPC ..... *E05B 77/38* (2013.01); *E05B 85/13* (2013.01); *E05B 85/12* (2013.01); *Y10T 292/57* (2015.04)

(58) Field of Classification Search

CPC ..... Y10T 292/57; E05B 85/10; E05B 85/12; E05B 85/13; E05B 77/38

See application file for complete search history.

(56) References Cited

U.S. PATENT DOCUMENTS 4,993,763 A * 2/1991 Tanimoto ..... E05B 85/12 292/336.3
5,613,717 A * 3/1997 Ha ..... E05B 15/004 292/336.3

(Continued)

FOREIGN PATENT DOCUMENTS

CN 102858566 1/2013
FR 2989716 A1 * 10/2013 ..... E05B 77/38

(Continued)

OTHER PUBLICATIONS

Chinese Office Action dated Nov. 25, 2015, 6 pages.
Japanese Office Action dated Jun. 14, 2016 and partial English Translation, 6 pages.

*Primary Examiner* — Daniel J Troy
*Assistant Examiner* — Andres Gallego
(74) *Attorney, Agent, or Firm* — Rankin, Hill & Clark LLP

(57) ABSTRACT

A vehicle door handle device, which is mounted on a side of a vehicle door facing a passenger compartment, includes: a door lock knob provided on a base member such that the door lock knob is pivotable between a locking position for placing the door in a locked state and an unlocking position for placing the door in an unlocked position; and a stopper provided on the base member between the locking position and the unlocking position for limiting pivoting movement of the door lock knob. The stopper has an elastic section, and the door lock knob has a locking surface section for abutting against the elastic section of the stopper when the door lock knob is in the locking position and an unlocking surface section for abutting against the elastic section of the stopper when the door lock knob is in the unlocking position.

7 Claims, 7 Drawing Sheets

(56) References Cited

U.S. PATENT DOCUMENTS

| | | | | |
|---|---|---|---|---|
| 2006/0255600 | A1* | 11/2006 | Belchine, III | E05B 17/0004 292/336.3 |
| 2011/0101709 | A1* | 5/2011 | Katsumata | E05B 81/14 292/201 |

FOREIGN PATENT DOCUMENTS

| | | | |
|---|---|---|---|
| JP | S59-128868 | U | 8/1984 |
| JP | H02-88855 | A | 3/1990 |
| JP | H07-32134 | U | 6/1995 |
| JP | 08-184222 | | 7/1996 |
| JP | 2009-127288 | A | 6/2009 |

* cited by examiner

VEHICLE DOOR HANDLE DEVICE

FIELD OF THE INVENTION

The present invention relates to a vehicle door handle device mounted on a side of a vehicle door facing a passenger compartment.

BACKGROUND OF THE INVENTION

Many vehicles include a door handle device mounted on a side of a vehicle door facing a passenger compartment, one example of which is disclosed in Japanese Patent Application Laid-open Publication No. HEI-8-184222 (hereinafter referred to as "the relevant prior patent literature").

The door handle device disclosed in the relevant prior patent literature comprises: a base member as a body mounted on the door; a door lock knob pivotably mounted on the base member for switching between locked and unlocked states of the door; and an operation handle mounted beneath the door lock knob and operable by a user to perform a door opening/closing operation.

The vehicle door handle devices proposed in recent years are constructed in such a manner that, as a user or vehicle occupant pivots the operation handle in a door opening direction with the door lock knob kept in a door locking position, the door lock knob is pivoted to a door unlocking position. Further, as the vehicle occupant gets out of the vehicle with a key held by the vehicle occupant and reaches a predetermined distance away from the vehicle, the door lock knob can be automatically pivoted to the door locking position. It is desirable if sound generated by the pivoting movement of the door lock knob can be suppressed, because such suppression of the sound can significantly enhance a high-class feeling of the vehicle.

SUMMARY OF THE INVENTION

In view of the foregoing prior art problems, it is an object of the present invention to provide an improved technique which can effectively suppress sound generated by the pivoting movement of the door lock knob.

In order to accomplish the abovementioned object, the present invention provide an improved vehicle door handle device mounted on a side of a vehicle door facing a passenger compartment, which comprises: a door lock knob provided on a base member for pivoting movement between a locking position for placing the door in a locked state and an unlocking position for placing the door in an unlocked position; and a stopper provided, on the base member between the locking position and the unlocking position of the door lock knob, for limiting the pivoting movement of the door lock knob, the stopper having an elastic section, the door lock knob having a locking surface section for abutting against (abuttingly contacting) the elastic section of the stopper when the door lock knob is in the locking position and an unlocking surface section for abutting against (abuttingly contacting) the elastic section of the stopper when the door lock knob is in the unlocking position.

According to the present invention, the pivoting movement of the door lock knob is limited by the door lock knob contacting the elastic section. Because a portion of the stopper to be contacted by the door lock knob comprises the elastic section, it is possible to effectively minimize or suppress sound (contact sound) that would be generated by the pivoting door lock knob contacting that portion. Namely, contact sound that would be generated by the pivoting door lock knob can be effectively suppressed, so that the vehicle can have an enhanced high-class feeling.

In addition, the stopper for limiting the pivoting movement of the door lock knob is provided between the locking position and the unlocking position of the door lock knob. Namely, the single stopper limits not only the pivoting movement, in the locking direction, of the door lock knob but also the pivoting movement, in the unlocking direction, of the door lock knob. Because amounts of the pivoting movement in both of the locking and unlocking directions can be limited by the single member in this manner, the vehicle door handle device of the present invention can be considerably simplified in construction.

Preferably, the stopper includes a stopper base section formed thereon and protruding therefrom between the locking position and the unlocking position of the door lock knob, and the elastic section is in the form of a ring-shaped rubber member constructed as a separate component part from the stopper base section and fitted over the outer periphery of the stopper base section. The locking position and the unlocking position of the door lock knob can be adjusted finely by merely replacing the rubber member with another rubber member having a different thickness from the previous rubber member. Further, because the stopper can be provided by merely fitting the ring-shaped rubber member, the stopper can be simplified in construction.

Preferably, the stopper has a substantially rectangular sectional shape, and the locking surface section of the door lock knob abuts against a surface portion of the elastic section corresponding to one short side of the stopper when the door lock knob is in the locking position, and the unlocking surface section of the door lock knob abuts against another surface portion of the elastic portion corresponding to the other short side of the stopper when the door lock knob is in the unlocking position. Namely, long sides of the stopper are disposed generally in parallel to the pivoting direction of the door lock knob. Such arrangements can prevent unwanted collapsing of the stopper and thereby secure a high strength of the stopper.

Preferably, the vehicle door handle device of the present invention further comprises an operation handle that is pivotably mounted on the base member and operable to pivot in a predetermined direction to open the door, and the stopper is provided near a pivot shaft of the operation handle. Namely, the stopper is provided on a portion of the base member that is increased in rigidity by the pivot shaft of the operation handle, so that the stopper can have an increased strength.

Preferably, a height position at which the locking surface section abuts against the elastic section of the stopper and a height position at which the unlocking surface section abuts against the elastic section of the stopper are different from each other. Because of such different abutting height positions of the locking surface section and the unlocking surface section, abutting impacts applied from the pivoting door lock knob can be dispersed to different regions of the stopper rather than to just one region of the stopper; that is, abutting impacts from the locking surface section and unlocking surface section of the pivoting door lock knob can be imparted alternately to the different regions of the stopper. As a result, the stopper can have a longer operating life.

Preferably, a section of the door lock knob between the locking surface section and the unlocking surface section is contoured to generally correspond to the contour of the stopper. Namely, portions of the door lock knob at and around the locking surface section and the unlocking surface section are contoured to generally correspond to the contour of the stopper. Thus, the portions of the door lock knob at and around the locking surface section and the unlocking surface section can be formed as large as possible, with the result that the locking surface section and the unlocking surface section can have an increased strength.

Preferably, the base member has a rib formed thereon to extend along a protruding direction of the stopper base section. Such a rib can increase the rigidity of the stopper base section, so that a high strength of the stopper base section can be secured.

Preferably, the stopper base section has an anti-slipoff portion formed at the distal end thereof and having an outside dimension greater than an inside dimension of the rubber member. Such an arrangement can prevent the rubber member from slipping off from the stopper base section and allows the locking surface section and the unlocking surface section to reliably contact the rubber member (elastic section). In this way, the present invention can minimize or suppress generation of unwanted contact sound with an increased reliability.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

In the following description, the terms "front", "rear", "left", "right", "upward", "downward" etc. are used to refer to directions as viewed from a passenger or occupant of a vehicle (vehicle occupant) or in a traveling direction of the vehicle.

An embodiment of a vehicle door handle device 20 of the present invention will be described hereinbelow in relation to a case where it is mounted on a front right door of the vehicle.

Figure 1:
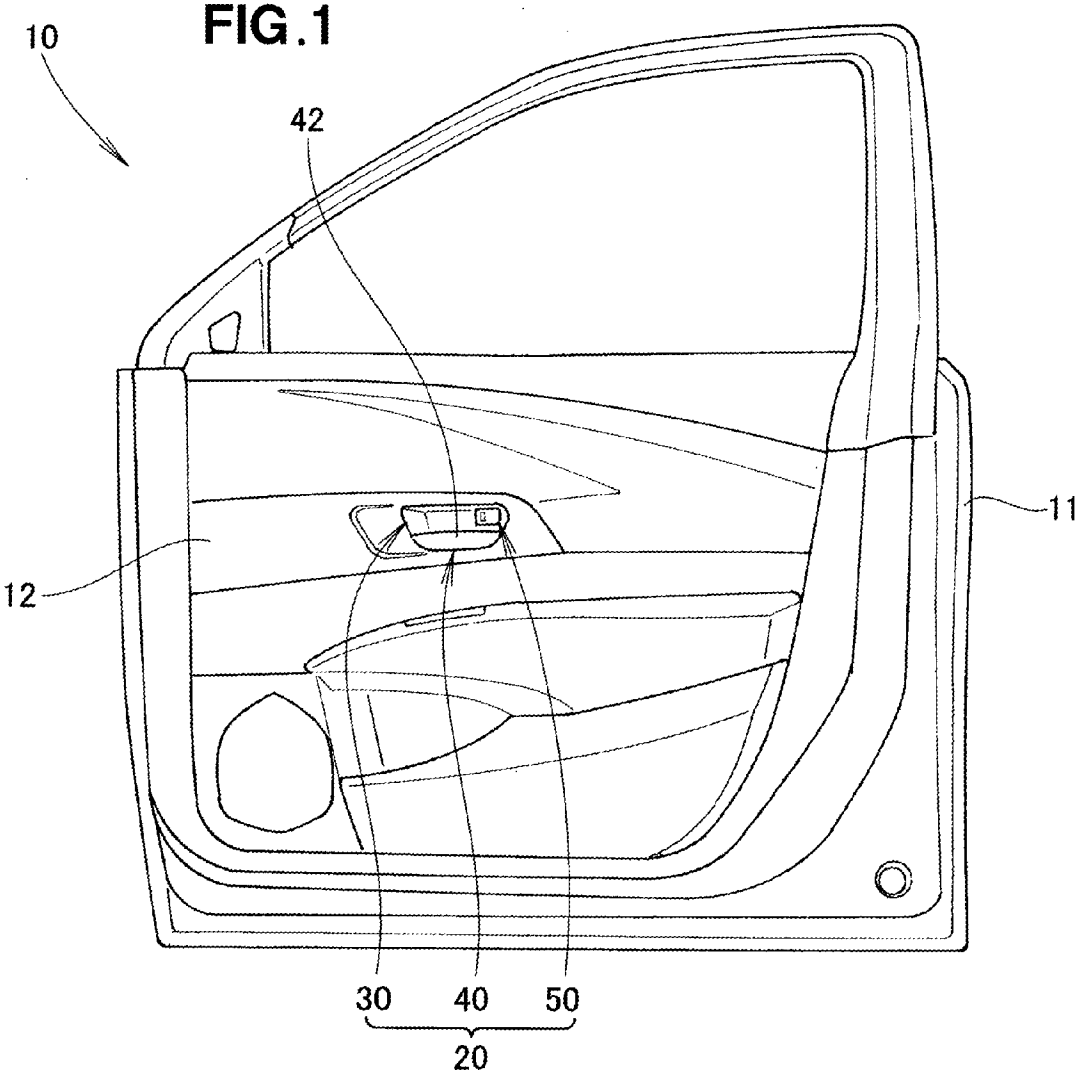
FIG. 1 is a front view of a vehicle door provided with an embodiment of a vehicle door handle device according to the present invention.

FIG. 1 is a front view of the vehicle door 10 as viewed from inside a passenger compartment. As shown in FIG. 1, a surface of a door panel 11 facing the passenger compartment (i.e., a surface of the door panel 11 closer to a person viewing the figure) is covered with a lining 12, and the vehicle door handle device 20 is supported by the door panel 11 and the lining 12.

The vehicle door handle device 20 is a device operable by a vehicle occupant to not only switch between a locked state and an unlocked state of the vehicle door 10 but also perform an opening/closing operation of the vehicle door 10. Details of the vehicle door handle device 20 will be discussed with reference to FIG. 2 etc.

Figure 2:
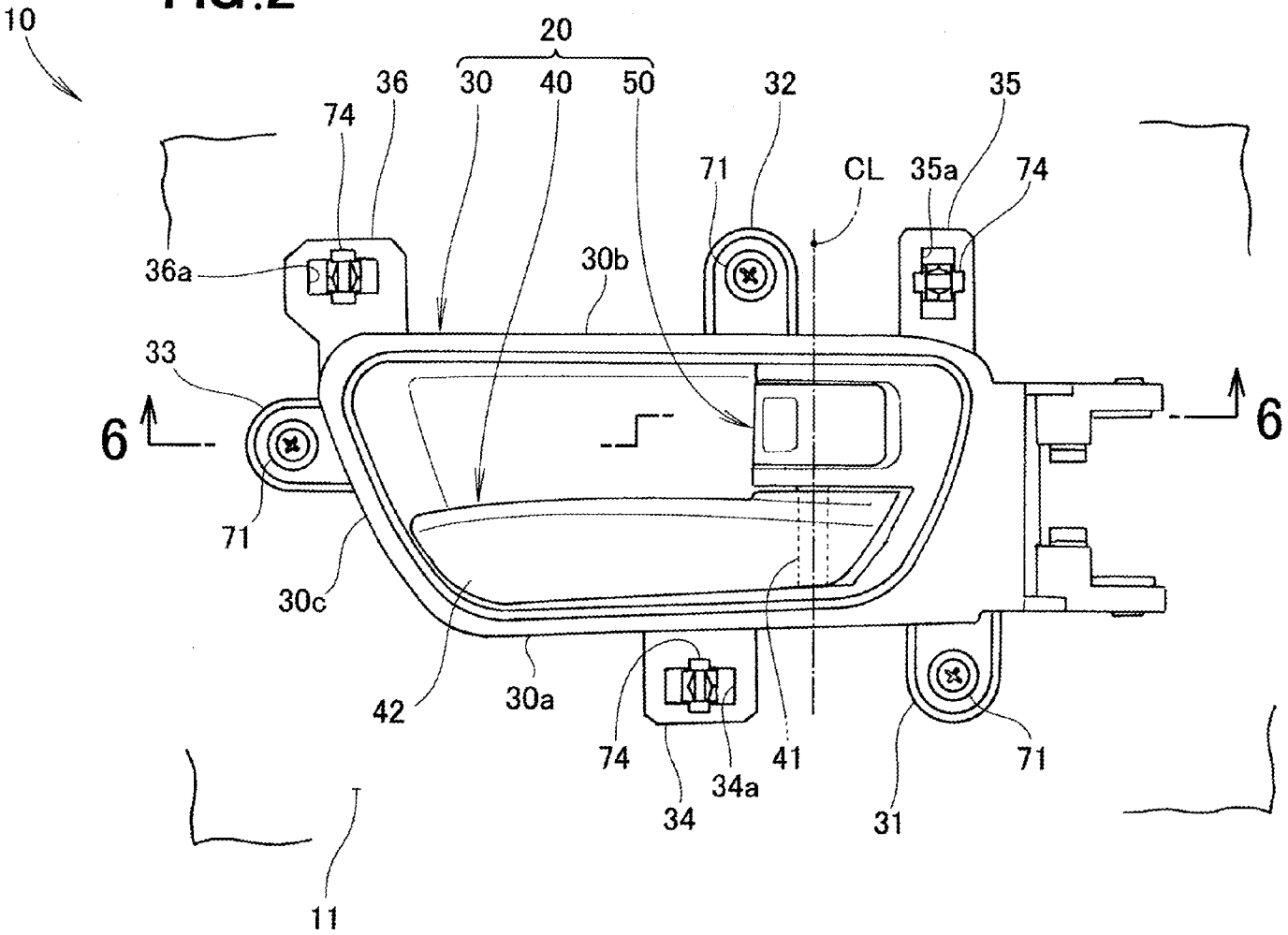
FIG. 2 is an enlarged front view showing the vehicle door handle device of FIG. 1.
Figure 3:
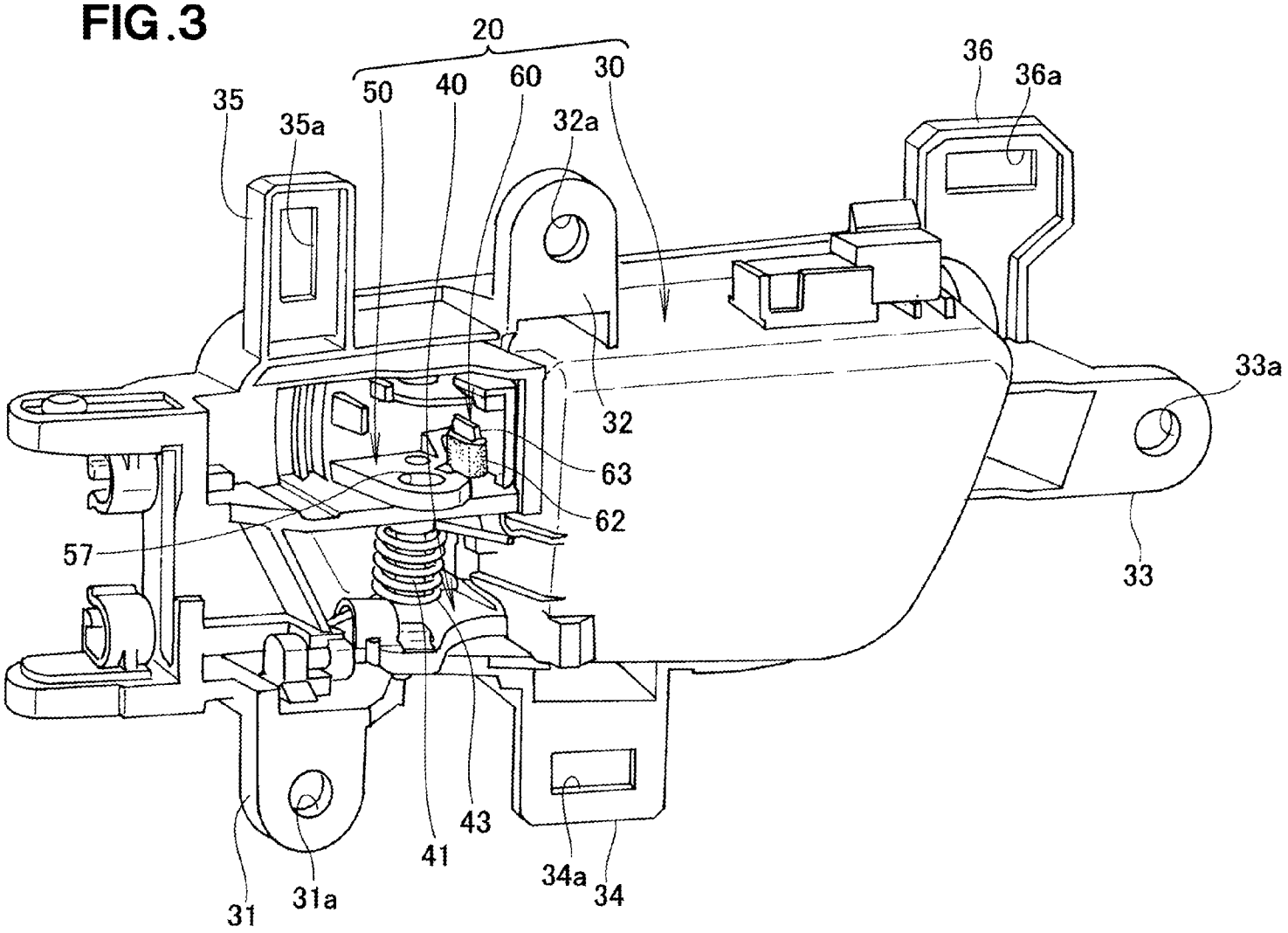
FIG. 3 is a rear perspective view of the vehicle door handle device shown in FIG. 2.

As shown in FIGS. 2 and 3, the vehicle door handle device 20 includes: a base member 30 formed like a container of a rectangular shape as viewed in front elevation; an operation handle 40 pivotably mounted on the base member 30 and operable by the vehicle occupant to pivot to perform an opening/closing operation of the vehicle door 10; a door lock knob 50 mounted on the base member 30 above the operation handle 40 for pivoting movement between a locking position for placing the vehicle door 10 in the locked state and an unlocking position for placing the vehicle door 10 in the unlocked state in response to a vehicle occupant's operation for switching between the locked state and the unlocked state of the vehicle door 10; and a stopper 60 for limiting the pivoting movement, between the locking and unlocking positions, of the door lock knob 50. The base member 30 is a member formed by injection-molding resin.

The operation handle 40 has a pivot shaft 41 mounted on the base member 30, and a handle section 42 mounted on the pivot shaft 41 for gripping by the vehicle occupant.

The pivot shaft 41 is surrounded along its outer periphery with a coil spring 43, and the handle section 42 is normally biased toward the base member 30. To open the vehicle door 10, the vehicle occupant pivots the handle section 42 toward the passenger compartment (i.e., toward a person viewing FIG. 2) against the biasing force of the spring 43.

On the outer periphery of the base member 30 are formed three mounting sections 31 to 33 for mounting the vehicle door handle device 20 to the door panel 11, as well as three mounting sections 34 to 36 for attaching the vehicle door handle device 20 to the lining 12.

One of the three mounting sections 31 to 33 which is formed behind or rearward of the lower edge 30*a* of the base member 30 and the axis line CL of the pivot shaft 41 will hereinafter be referred to as "first mounting-to-panel section 31". Another one of the three mounting sections 31 to 33 which is formed in front of or forward of the upper edge 30*b* of the base member 30 and the axis line CL of the pivot shaft 41 will hereinafter be referred to as "second mounting-to-panel section 32". Further, the other of the three mounting sections 31 to 33 which is formed on the front edge 30*c* of the base member 30 will hereinafter be referred to as "third mounting-to-panel section 33".

The first to third mounting-to-panel sections 31 to 33 have respective mounting holes 31*a* to 33*a*, each in the form of a circular hole, through which stepped bolts 71 are inserted to fasten the vehicle door handle device 20 to the door panel 11.

One of the three mounting sections 34 to 36 which is formed forward of the lower edge 30*a* of the base member 30 and the axis line CL of the pivot shaft 41 will hereinafter be referred to as "first mounting-to-lining section 34". Another one of the three mounting sections 34 to 36 which is formed rearward of the upper edge 30*b* of the base member 30 and the axis line CL of the pivot shaft 41 will hereinafter be referred to as "second mounting-to-lining section 35". Further, the other of the three mounting sections 34 to 36 which is formed on the front edge 30*c* and upper edge 30*b* of the base member 30 will hereinafter be referred to as "third mounting-to-lining section 36".

The first to third mounting-to-lining sections 34 to 36 have respective mounting holes 34*a* to 36*a* through which clips 74 are fittingly inserted. The clips 74 are provided integrally on the lining 12, and the vehicle door handle device 20 is attached to the lining 12 by means of the clips 74. In FIG. 2, only the clips 74 are shown with illustration of the lining 12 omitted for clarity. Details of the door lock knob 50 are discussed below with reference to FIG. 4 etc.

Figure 4:
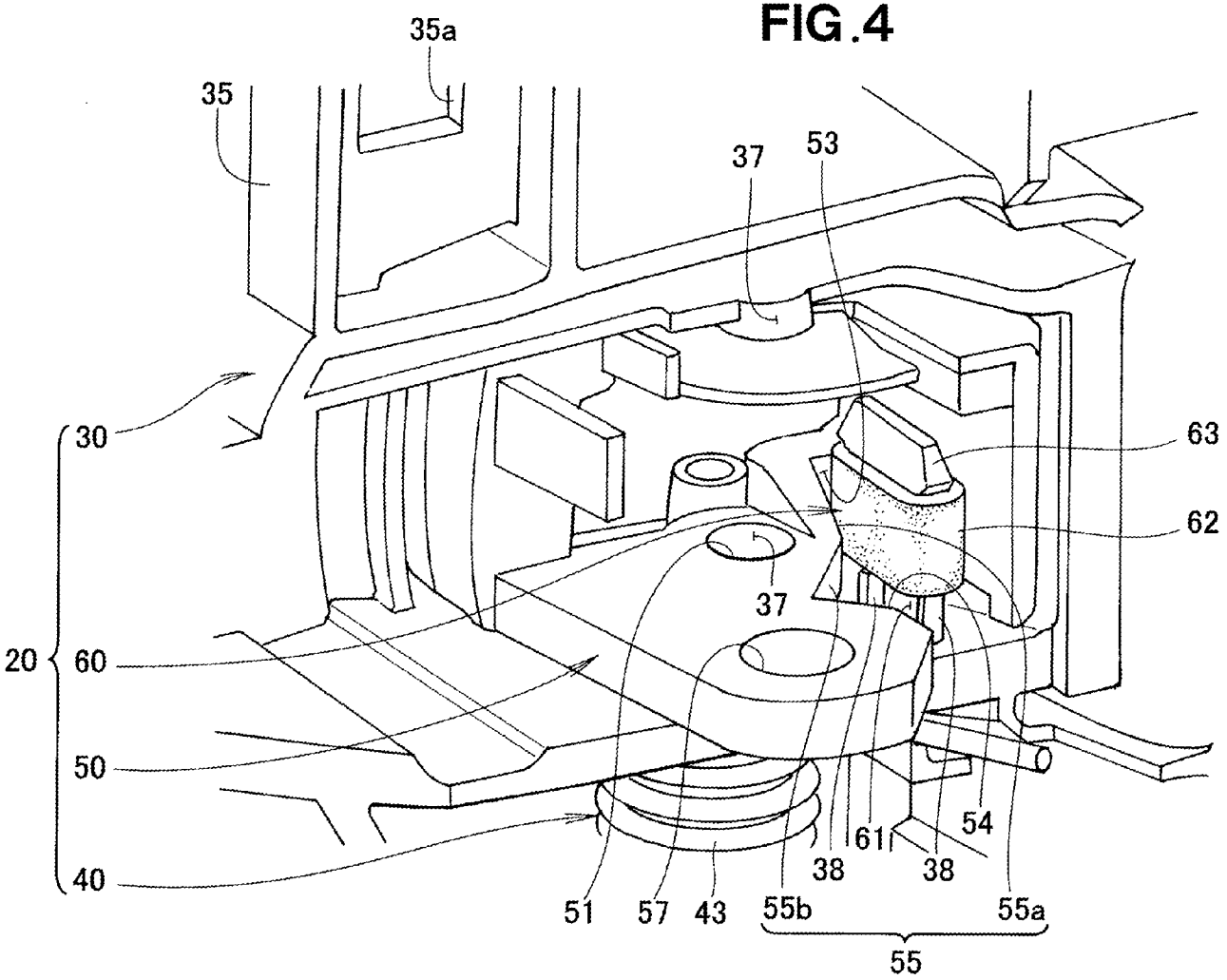
FIG. 4 is a perspective view of a door lock knob and a stopper shown in FIG. 3.

As shown in FIG. 4, the door lock knob 50 is an injection-molded component part pivotably mounted on the base member 30. The stopper 60 is provided on a portion of the base member 30 that is located on a trajectory of pivoting movement, between the locking position and the unlocking position, of the door lock knob 50.

Figure 5:
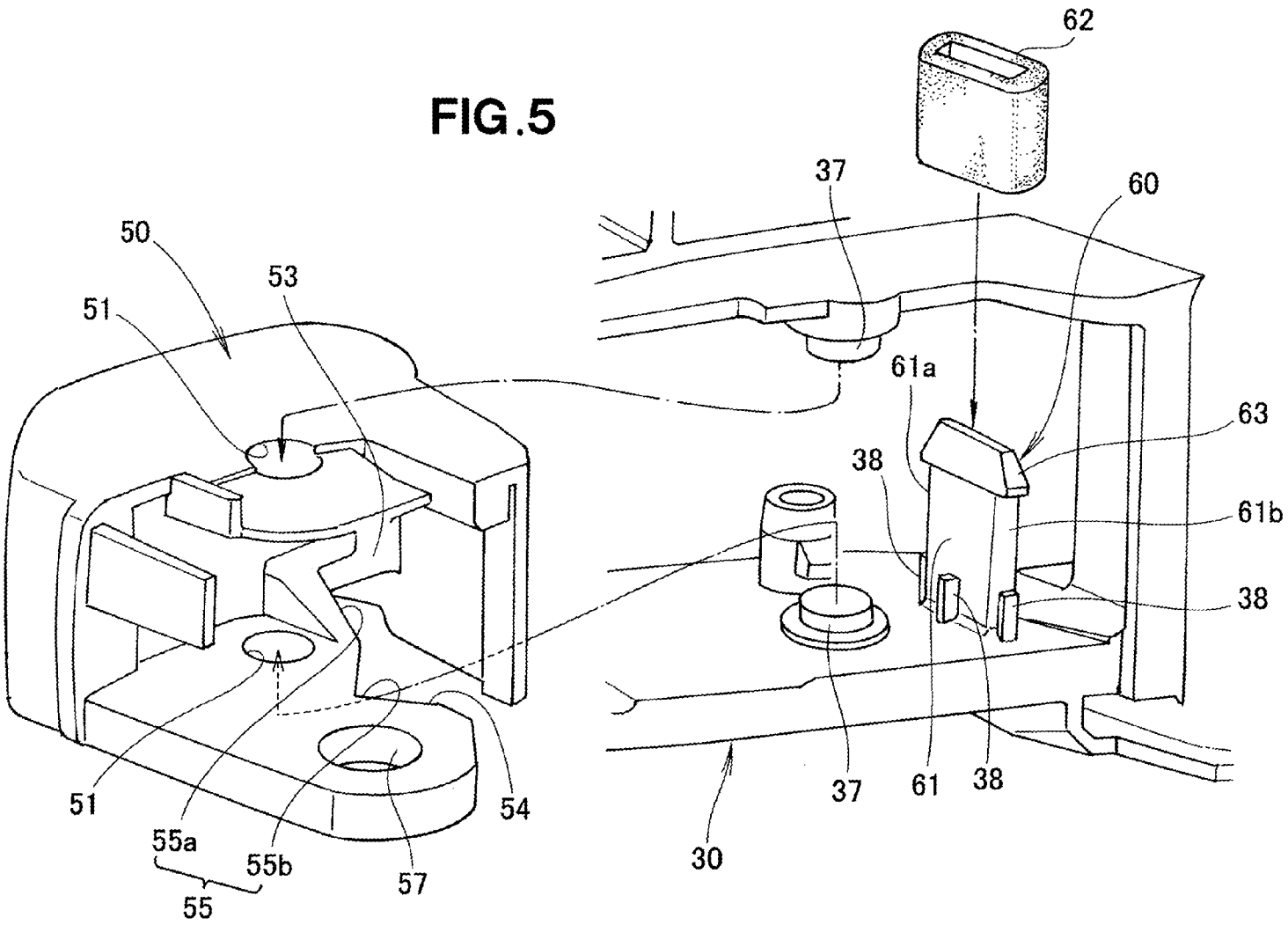
FIG. 5 is an exploded perspective view of the door lock knob and the stopper shown in FIG. 4.

As shown in FIG. 5, circular holes 51 are formed in the door lock knob 50, and circular columnar protrusions 37 are formed integrally on opposed surfaces of the base member 30. These protrusions 37 are fitted in the circular holes 51 of the door lock knob 50. The circular columnar protrusions 37 function as pivot shafts pivotably supporting the door lock knob 50. Because the protrusions 37 are formed as pivot shafts integrally on the base member 30, it is possible to not only reduce the number of necessary component parts but also reduce the overall size of the vehicle door handle device 20.

Referring back to FIG. 3, the stopper 60 is disposed near and above the pivot shaft 41 of the operation handle 40. The stopper 60 is provided on a portion of the base member 30 that is increased in rigidity by the pivot shaft 41, so that the stopper 60 can have an increased strength.

Further, as shown in FIG. 5, the stopper 60 has: a stopper base section 61 of a rectangular columnar shape formed integrally on the base member 30; a ring-shaped rubber member (elastic section) 62 provided as a separate component part from the stopper base section 61 and fitted over the outer periphery of the stopper base section 61; and an anti-slipoff portion 63 formed integrally on an upper end portion of the stopper base section 61 and having an outside dimension greater than an inside dimension of the ring-shaped rubber member 62 so as to prevent the rubber member 62 from slipping off from the stopper base section 61. The stopper base section 61 and the anti-slipoff portion 63 are injection-molded integrally with the base member 30.

Ribs 38 are injection-molded integrally with the base member 30 so as to extend upward to a same height position (vertical position) from the lower end of the stopper base section 61 along individual surfaces of the stopper base section 61. The ring-shaped rubber member 62 fitted over the stopper base section 61 are placed on the upper ends of the ribs 38 (see also FIG. 4). Namely, the ring-shaped rubber member 62 is positionally adjusted in a height (vertical) direction by selectively determining a desired height position (vertical position) of the upper ends of the ribs 38. Further, because the ribs 38 are formed along a protruding direction of the stopper base section 61, they can increase rigidity of the stopper base section 61, so that a high strength of the stopper base section 61 can be secured.

Figure 6:
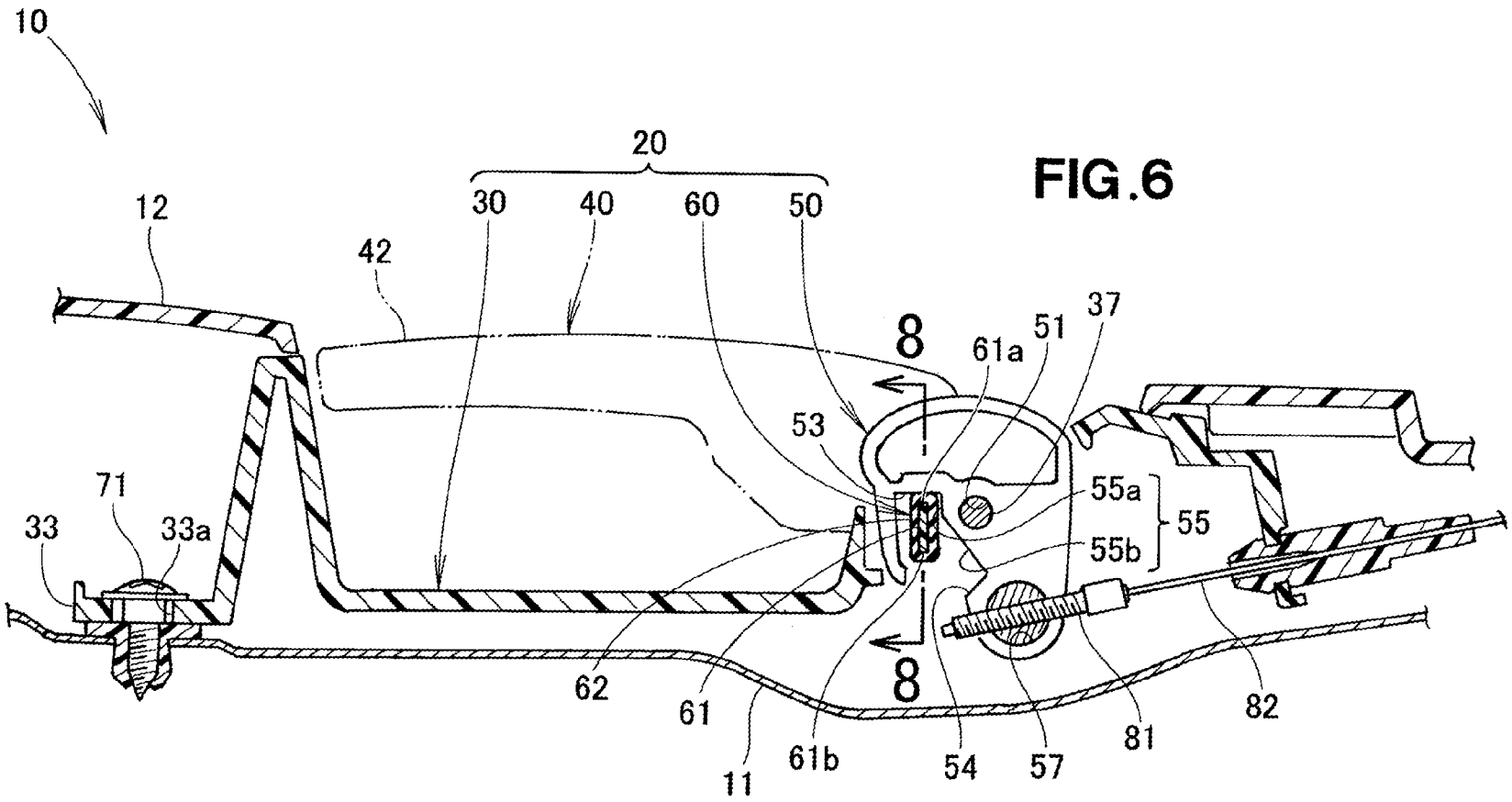
FIG. 6 is a sectional view taken along line 6-6 of FIG. 2.

FIG. 6 shows the door lock knob 50 in the door locking position. As shown in FIG. 6 the door lock knob 50 has a locking surface section 53 that abuts against the rubber member 52 when the door lock knob 50 is in the door locking position. The "locking position" in this specification means a state where the vehicle door 10 is locked so that it would not be opened even when the vehicle occupant pivots the operation handle 40 in a door opening direction.

Figure 7:
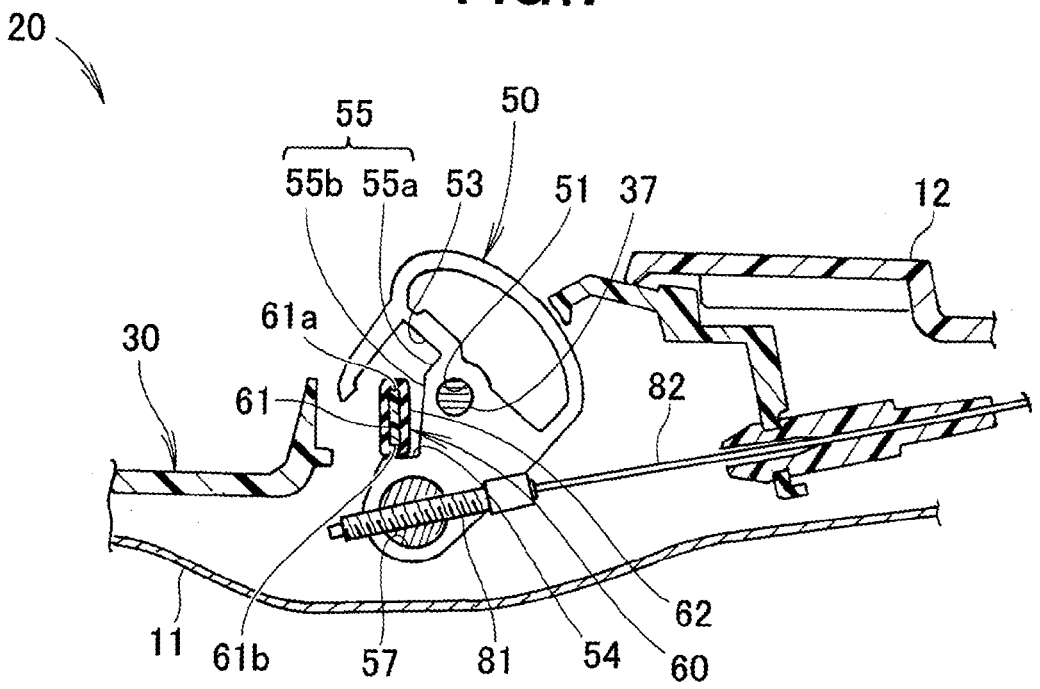
FIG. 7 is a view explanatory of a state in which the door lock knob shown in FIG. 6 is in an unlocking position.

FIG. 7 shows the door lock knob 50 in the unlocked position. As shown in FIG. 7, the door lock knob 50 has an unlocking surface section 53 that abuts against the rubber member 62 when the door lock knob 50 is in the door unlocking position. The "unlocking position" in this specification means a state where the vehicle door 10 is unlocked so that it can be opened in response to a pivoting operation by the vehicle occupant.

As shown in FIGS. 6 and 7, the door lock knob 50 has a connection section 55 (i.e., a part between the liking surface section 53 and the unlocking surface section 54) of a substantially V shape interconnecting the locking surface section 53 and the unlocking surface section 54. As viewed in top plan, one side surface 55*a* of the connection section 55 extends substantially at right angles from an end of the locking surface section 53 while the other side surface 55*b* of the connection section 55 extends substantially at right angles from an end of the unlocking surface section 54.

In the locking position, the locking surface section 53 abuts against a surface portion, corresponding to one short side 61*a* of the stopper base section 61 of a substantially rectangular sectional shape, of the rubber member (elastic section) 62, at which time the one side surface 55*a* of the connection section 55 extends along a side surface of the stopper base section 61, more specifically along a side surface of the stopper 60.

In the unlocking position, on the other hand, the unlocking surface section 54 abuts against a surface portion, corresponding to the other short side 61*b* of the stopper base section 61, of the rubber member (elastic section) 62, at which time the other side surface 55*b* of the connection section 55 extends along the side surface of the stopper base section 61, more specifically along the side surface of the stopper 60.

The door lock knob 50 further has a wire mounting hole 57 formed therein for connecting thereto a wire mounting member 81. As the door lock knob 50 is pivoted, the wire mounting member 81 connected to the door lock knob 50 moves together with the door lock knob 50, so that a wire connected at its distal end to the wire mounting member 81 too moves to thereby switch between the locked state and the unlocked state of the vehicle door 10.

The stopper 60 for limiting the pivoting movement of the door lock knob 50 includes the elastic rubber member (elastic section) 62. Namely, the pivoting movement of the door lock knob 50 is limited by the door lock knob 50 contacting the rubber member (elastic section) 62. Because a portion of the stopper 60 to be contacted by the door lock knob 50 comprises the elastic rubber member 62, it is possible to effectively minimize or suppress contact sound that would be generated by the pivoting door lock knob 50 contacting that portion. Namely, contact sound that would be generated by the pivoting door lock knob 50 can be effectively suppressed, so that the vehicle can have an enhanced high-class feeling. If the stopper 60 comprises only the stopper base section 61 without including the elastic rubber member 62, then relatively great contact sound would be generated as the door lock knob 50 and the stopper base section 61 contact each other.

In addition, the stopper 60 is provided to protrude between the locking position and the unlocking position. Namely, the single stopper 60 limits not only the pivoting movement, in the locking direction, of the door lock knob 50 but also the pivoting movement, in the unlocking direction, of the door lock knob 50. Because amounts of the pivoting movement in both of the locking and unlocking directions can be limited by the single member in this manner, the vehicle door handle device 20 can be considerably simplified in construction.

Further, the stopper base section 61 of the stopper 60 has a substantially rectangular sectional shape, and the locking surface section 53 abuts against the surface portion, corresponding to the one short side 61*a*, of the rubber member (elastic section) 62 while the unlocking surface section 54 abuts against the surface portion, corresponding to the other short side 61*b*, of the rubber member (elastic section) 62. Namely, the long sides of the stopper 60 are disposed generally in parallel to the pivoting direction of the door lock knob 50. Such arrangements can prevent unwanted collapsing of the stopper 60 and thereby secure a high strength of the stopper 60.

In addition, the connection section 55 between the locking surface section 53 and the unlocking surface section 54 is contoured to generally correspond to the contour of the stopper 60. Namely, portions of the door lock knob 50 at and around the locking surface section 53 and the unlocking surface section 54 are contoured generally in correspondence with the contour of the stopper 60. Thus, the portions of the door lock knob 50 at and around the locking surface section 53 and the unlocking surface section 54 can be formed as large as possible, with the result that the locking surface section 53 and the unlocking surface section 54 can have an increased strength.

Figure 8:
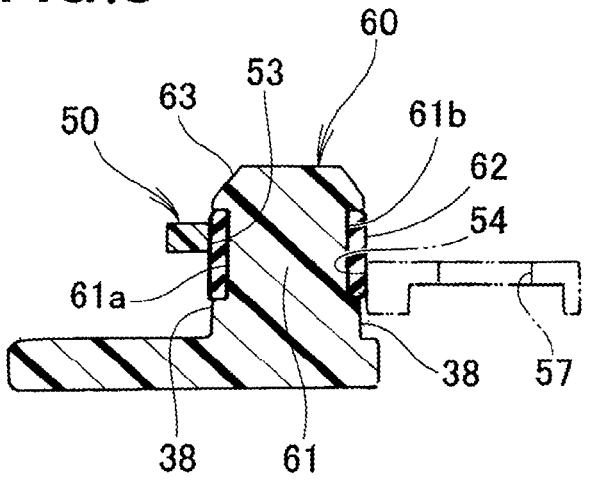
FIG. 8 is a sectional view taken along line 8-8 of FIG. 6.

Further, a height position at which the locking surface section 53 abuts against the rubber member (elastic section) 62 of the stopper 60 and a height position at which the unlocking surface section 54 abuts against the rubber member (elastic section) 62 are different from each other because the connection section 55 slants vertically as shown in FIG. 4. Namely, abutting height positions of the locking surface section 53 and unlocking surface section 54 relative to the stopper 61 differ from each other as shown in FIG. 8. An abutting impact is imparted to the stopper 60 by either the locking surface section 53 or the unlocking surface section 54 contacting the stopper 60. Because of the different abutting height positions of the locking surface section 53 and unlocking surface section 54, abutting impacts from the door lock knob 50 can be dispersed to different regions of the stopper 60 rather than to just one region of the stopper 60; that is, abutting impacts from the locking and unlocking surface sections 53 and 54 of the door lock knob 50 can be imparted alternately to the different regions of the stopper 60. As a result, the stopper 60 can have a longer operating life.

Whereas the embodiment of the vehicle door handle device of the present invention has been described above as mounted on the front right vehicle door, it may be mounted on a left or rear vehicle door and is not necessarily limited to the aforementioned construction.

Further, whereas the stopper base section 61 of the stopper 60 has been described as having a substantially rectangular sectional shape, it may have a circular, triangular or any other polygonal sectional shape. Furthermore, the locking position and the unlocking position of the door lock knob 50 can be adjusted finely as desired by merely replacing the rubber member 62, fitted over the stopper base section 61, with another rubber member having a different thickness from the previous rubber member.

The vehicle door handle device of the present invention is well suited for application to doors of automotive vehicles.

What is claimed is:

1. A vehicle door handle device mounted on a side of a vehicle door facing a passenger compartment, the vehicle door handle device comprising:

a door lock knob provided on a base member for pivoting movement between a locking position for placing the door in a locked state and an unlocking position for placing the door in an unlocked state; and a stopper provided on the base member for limiting the pivoting movement of the door lock knob between the locking position and the unlocking position of the door lock knob, the stopper having an elastic section, the door lock knob having a locking surface section for abutting against the elastic section of the stopper when the door lock knob is in the locking position and an unlocking surface section for abutting against the elastic section of the stopper when the door lock knob is in the unlocking position, wherein the stopper protrudes from the base member in a protruding direction, and wherein the stopper has a substantially rectangular cross-sectional shape along a plane perpendicular to the protruding direction of the stopper, and wherein the locking surface section of the door lock knob abuts against a surface portion of the elastic section corresponding to one short side of the substantially rectangular cross-sectional shape of the stopper when the door lock knob is in the locking position, and the unlocking surface section of the door lock knob abuts against another surface portion of the elastic section corresponding to another short side of the substantially rectangular cross-sectional shape of the stopper when the door lock knob is in the unlocking position.

2. The vehicle door handle device according to claim 1, wherein the stopper includes a stopper base section formed thereon and protruding therefrom in a space defined between the locking surface section and the unlocking surface section of the door lock knob, and the elastic section is in a form of a ring-shaped rubber member constructed as a separate component part from the stopper base section and fitted over an outer periphery of the stopper base section.

3. The vehicle door handle device according to claim 2, wherein the base member has a rib formed thereon to extend along a protruding direction of the stopper base section.

4. The vehicle door handle device according to claim 2, wherein the stopper base section has an anti-slipoff portion formed at a distal end thereof and having an outside dimension greater than an inside dimension of the rubber member.

5. The vehicle door handle device according to claim 1, which further comprises an operation handle pivotably mounted on the base member, the operation handle being operable to pivot in a predetermined direction to open the door, and wherein the stopper is provided near a pivot shaft of the operation handle.

6. The vehicle door handle device according to claim 1, wherein a height position at which the locking surface section abuts against the elastic section of the stopper and a height position at which the unlocking surface section abuts against the elastic section of the stopper are different from each other.

7. The vehicle door handle device according to claim 1, wherein a section of the door lock knob between the locking surface section and the unlocking surface section is contoured to generally correspond to a contour of the stopper.

* * * * *